US006012206A

United States Patent [19]

Goineau

[11] Patent Number: 6,012,206

[45] Date of Patent: Jan. 11, 2000

[54] LOOP BREAKER FOR TEXTURED YARN

[75] Inventor: Andre' M. Goineau, Spartanburg, S.C.

[73] Assignee: Milliken & Company, Spartanburg, S.C.

[21] Appl. No.: 09/301,034

[22] Filed: Apr. 28, 1999

[51] Int. Cl.[7] ..... D02G 1/16; D02J 3/02

[52] U.S. Cl. ..... 28/220; 57/127.5; 28/219

[58] Field of Search ..... 28/219, 220, 247, 28/217, 172.1, 240, 284, 299; 57/281, 112, 127.5, 127.7, 136; 19/66 T, 65 R, 35; 248/511, 512, 513, 534, 539, 317

[56] References Cited

U.S. PATENT DOCUMENTS

| | | | |
|---|---|---|---|
| 2,276,208 | 3/1942 | Kline | 57/2 |
| 4,501,046 | 2/1985 | Krenzer | 19/35 |
| 4,852,226 | 8/1989 | Goineau | 28/220 |
| 4,860,412 | 8/1989 | Goineau | 28/219 |
| 4,864,701 | 9/1989 | Goineau | 28/220 |
| 4,959,895 | 10/1990 | Sager | 28/219 |
| 4,972,563 | 11/1990 | Wheeler | 28/220 |

*Primary Examiner*—Amy Vanatta
*Attorney, Agent, or Firm*—Terry T. Moyer; Earle R. Marden

[57] ABSTRACT

An apparatus to produce a spun-like synthetic yarn which employs a filament loop breaker which is periodically and automatically opened to break the vacuum pressure to allow lint collected therein to be released and collected. The apparatus includes cantilever suspended rolls to open up the interior of the filament loop breaker to provide more efficient lint removal resulting in the ability to run at higher speeds.

11 Claims, 3 Drawing Sheets

FIG. —1—

LOOP BREAKER FOR TEXTURED YARN

This invention relates to a yarn texturing process in which an effect yarn forms loops around a core yarn and the loops are broken by a suitable loop breaking device to provide a synthetic yarn with a spun-like yarn appearance.

It is an object of the invention to provide a process and apparatus to provide a spun-like synthetic yarn in which the filament loop breaker is automatically and periodically cleaned of accumulated lint.

Other objects and advantages of the invention will become readily apparent as the specification proceeds to describe the invention with reference to the accompanying drawings, in which.

Figure 1:
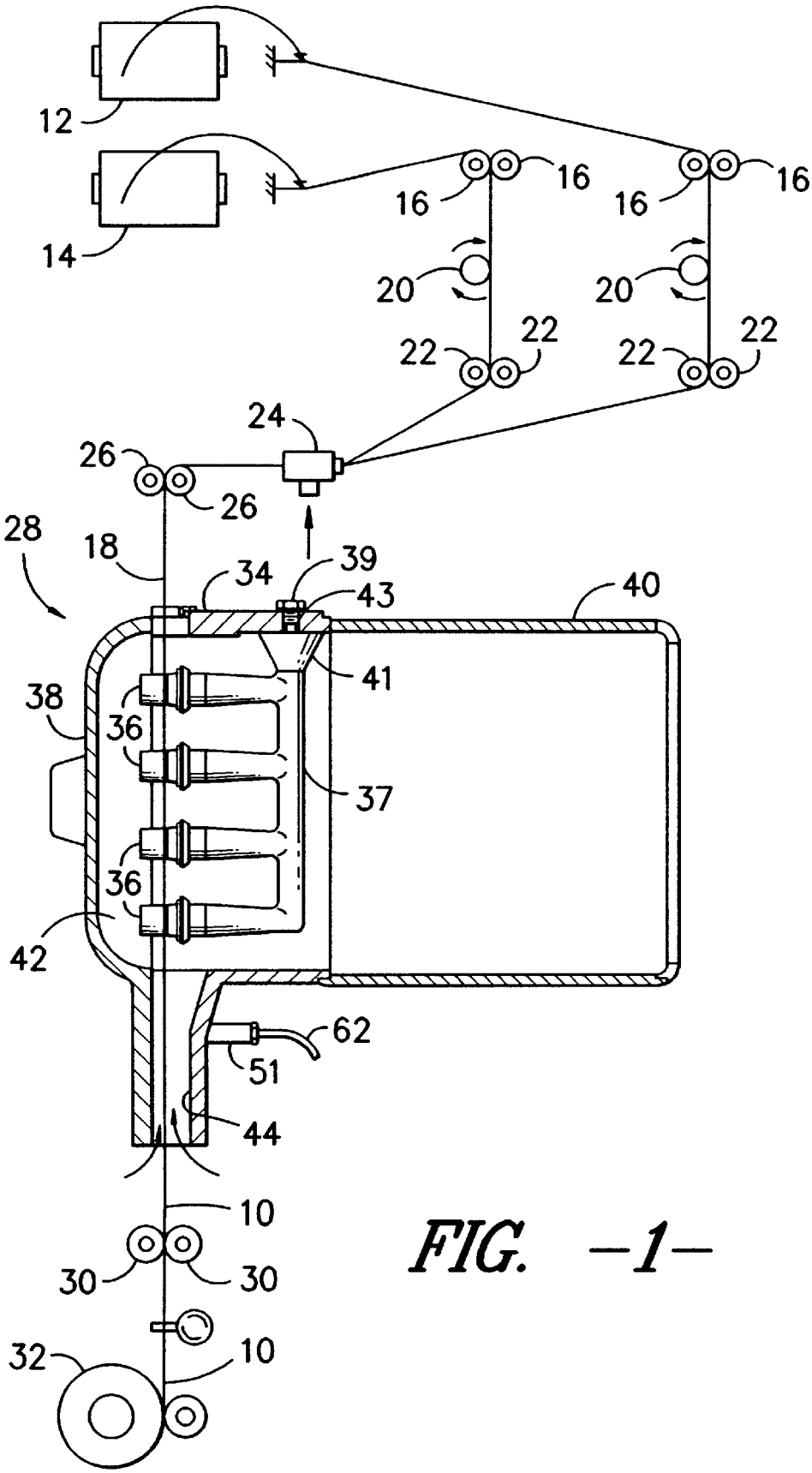
FIG. 1 is a schematic drawing of the process to manufacture a spun-like synthetic yarn.
Figure 2:
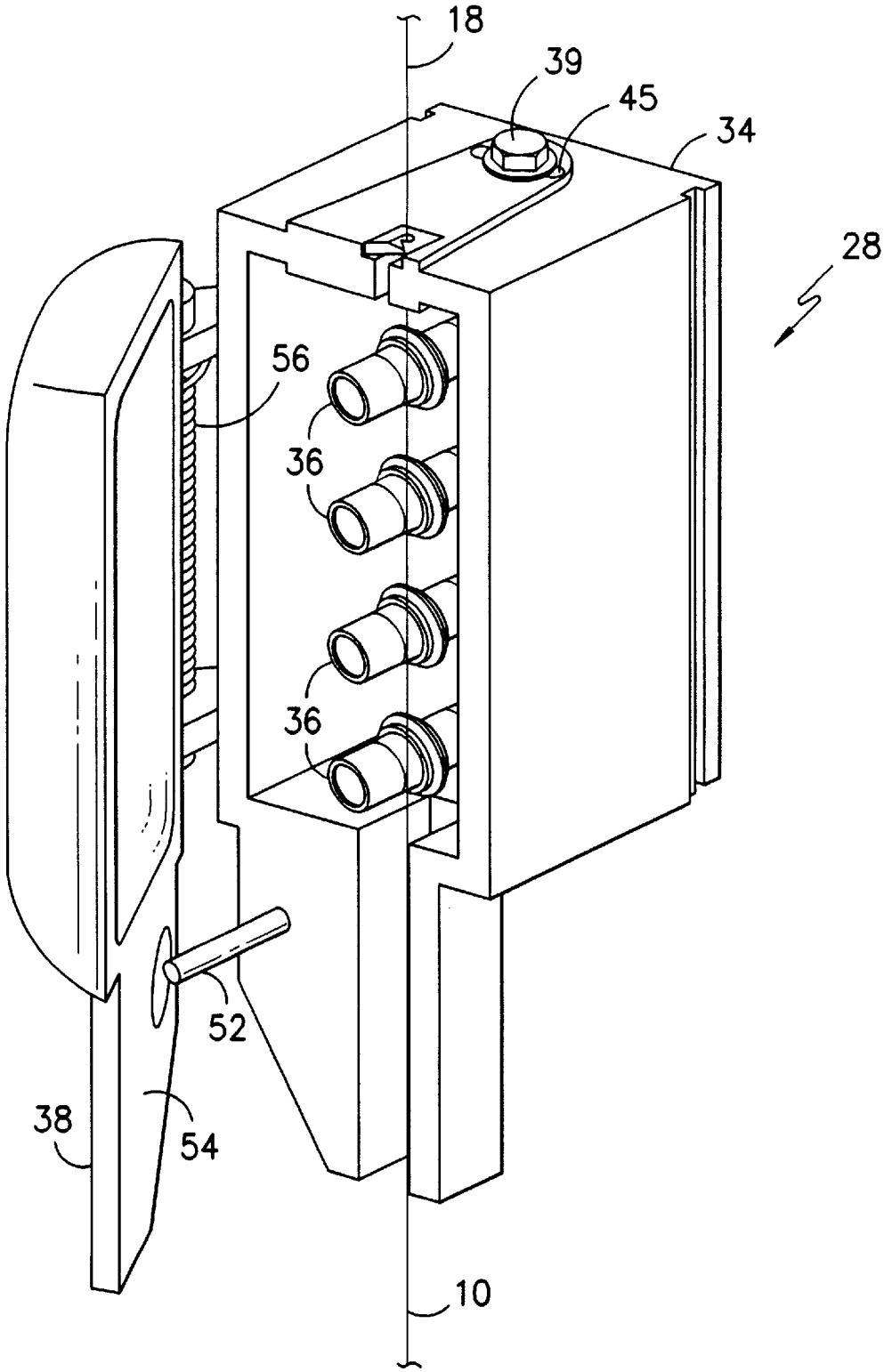
FIG. 2 is a blow-up schematic view of the filament loop breaker shown in FIG. 1.

Looking now to FIG. 1, the overall system is shown to produce a spun-like synthetic yarn 10. The starting yarns are 255/68 continuous filament polyester yarns from packages 12 and 14 which are merged in jet 24. The yarn 18 exits the nip of rolls 16 at a speed of 276 meters/minute and is wrapped around the hot pin 20 prior to being drawn by the rolls 22 delivering yarn at a rate of 469 meters/minute. The hot pin 20 is, preferably, maintained at a temperature of about 155° C.

The drawn yarn 18 is then supplied to an air texturing jet 24 supplied with air at a pressure of about 150 p.s.i. wherein, due to the lower speed of the rolls 26 of 344 meters, one of the yarns of the merged yarn 18 wraps around the other of the yarns and is formed into a series of loops. The air textured yarn 18 is then supplied from the rolls 26 through the filament loop breaker 28 to the rolls 30. The spun-like synthetic yarn 10 is then supplied from the rolls 30 at a speed of 400 meters/minute to the take-up package 32 taking up yarn at a rate of 479 meters/minute.

The filament loop breaker 28 basically is a modified version of a commercially available unit such as the Texspun unit manufactured by Barmag Maschinenfabrik Aktiengesellschaft in its FK6T-80 air texturing machine and described in U.S. Pat. No. 4,501,046 and consists of housing 34 having a plurality of rolls 36 therein around which the yarn 18 is wrapped, a door 38 to provide access to the rolls 36 for threadup and a vacuum chamber 40 connected to suitable vacuum source to suck yarn and lint from the chamber 42 created by the breaking of the loops of the air textured yarn 18. The yarn exits through the channel 44 to the rolls 30.

The above-noted filament yarn breaker 28 has been modified to enlarge the vacuum chamber 40 and provide a cantilever support member 37 for the rolls 36 rather than the independent roll support as shown in U.S. Pat. No. 4,860,412. This allows the lint to freely flow into the vacuum chamber and reduces the number of times that the yarn 18 gets broken by the lint accumulation and the door 38 has to be opened to allow accumulated lint to drop out. The cantilevered support is held in position by a screw 39 screwed into the coned portion 41 of the support 37 with the upper portion 43 thereof being rectangular to fit into the slot 45 to prevent rotation of the cantilever support 37 during operation. The vacuum chamber 40 is connected to a suitable vacuum source to pull the lint out of the vacuum chamber 40.

In operation it has been found that a lot of lint, rather than being pulled in the chamber 40, tends to adhere to the rolls 36 and the inner surface of the housing 34 in the chamber 42. To alleviate this situation, a solenoid actuated air cylinder 51 has been mounted on the back of each unit 28 with its piston rod 52 projecting into and against the inner surface 54 of the door 38. Periodically the air cylinder 51 is pulsed to force the piston rod 52 outward so that it contacts the door surface 54 to open the door 38 against the action of the spring 56. Opening of the door 38 breaks the vacuum in the chamber 42 allowing the accumulated lint to fall from the surface adhered to and either fall through the channel 44 and/or be pulled into the vacuum chamber 40 when the door 38 has been released by the piston rod 52. This periodic and automatic opening and closing of the door 38 prevents the accumulation of lint, etc. in the vacuum and loop breaking chamber 42.

Figure 3:
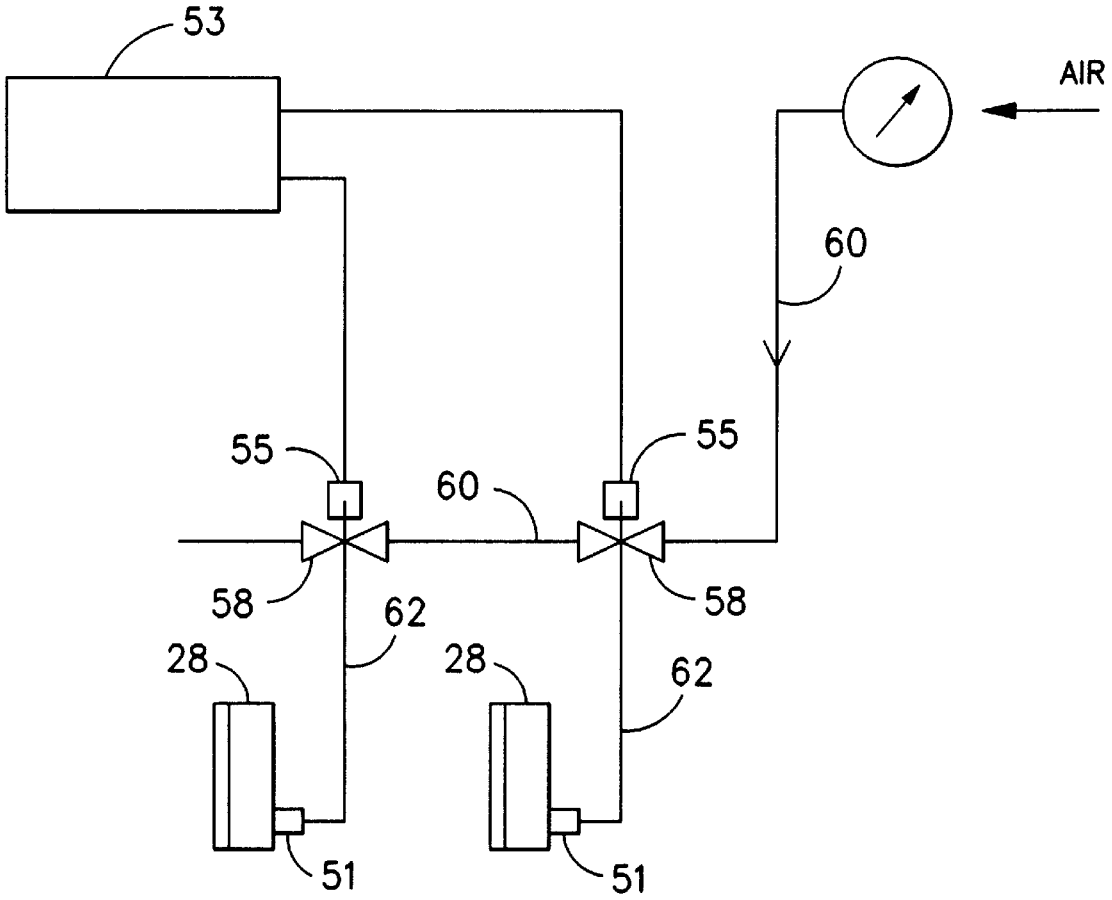
FIG. 3 is a simple schematic view of the control circuit for the automatic door opener of the filament loop breaker.

FIG. 3 schematically represents a simple control diagram showing that a programmable controller 53 is connected to a series of solenoids 55 to periodically, as programmed, activate the three-way valves 58 to supply air from the high pressure air line 60 into the conduit 62 to the desired air cylinder 51. The sequence and number of openings and closings of the doors 38 depends on the program of the computer 53.

It can be seen that the herein-disclosed filament loop breaker has been provided with an improvement which will automatically and periodically allow accumulated lint therein to be dissipated so that the loop breaker does not clog up and such lint, etc. does not end in the yarn 10 causing unwanted defects, yarn breaks and/or other effects therein. Also, the combination of the large vacuum chamber and cantilevered roll support allows more lint to be taken into the chamber 40 thereby allowing increased production speeds.

Although the preferred embodiment has been described specifically, it is contemplated that changes may be made without departing from the scope or spirit of the invention and it is desired that the invention be limited only by the scope of the claims.

What is claimed is:

1. A loop breaker for a textured yarn having a plurality of loops on the surface thereof comprising: a housing having a partial hollow interior, a door closing the hollow interior of said housing, means applying a suction pressure inside said housing, a plurality of rolls around which the textured yarn is wrapped are rotatably mounted in said housing by a cantilevered support member to allow ready access to said suction pressure, means biasing said door to the closed position, and a means operably associated with said housing to periodically open said door to allow accumulated lint to fall from interior surfaces of the housing and rolls.

2. The loop breaker of claim 1 wherein said means operably associated with said housing includes a plunger operably connected to an air cylinder and a means to periodically supply air to said air cylinder to periodically open said door.

3. The loop breaker of claim 2 wherein said door includes a spring means to bias said door to the closed position.

4. The loop breaker of claim 3 wherein said plunger projects through said housing against the inside of said door and said air cylinder is mounted on the outside of said housing opposite to said door.

5. A loop breaker for a textured yarn having a plurality of loops in the surface thereof comprising a housing having a hollow interior, said housing having a first portion and a second portion, a door closing the hollow interior, a cantilevered support member supporting a plurality of rotatably mounted rolls in said first portion and means operably associated with said second portion to apply a negative pressure to said first and second portions to pull accumulated lint from said first and second portions of said hollow interior.

6. The loop breaker of claim 5 wherein said first portion is smaller than said second portion.

7. The loop breaker of claim 5 wherein a means is operably associated with said housing to periodically open said door to allow accumulated lint to fall from interior surfaces of the housing and said rolls.

8. The loop breaker of claim 7 wherein said means operably associated with said housing includes a plunger operably connected to an air cylinder and a means to periodically supply air to said air cylinder to periodically open said door.

9. The loop breaker of claim 8 wherein said door includes a spring means to bias said door to the closed position.

10. The loop breaker of claim 9 wherein said plunger projects through said housing against the inside of said door and said air cylinder is mounted on the outside of said housing opposite to said door.

11. A roll support member for a plurality of rotatable rolls comprising a conical section adapted to be connected to a support member, an elongated body member connected to said conical section, a plurality of roll support members extending at substantially perpendicular to said elongated body member and being connected, and roll members connected to and rotatably supported on the outer end of each roll support member.

* * * * *